US006686687B2

(12) United States Patent
Van Mensvoort et al.

(10) Patent No.: US 6,686,687 B2
(45) Date of Patent: Feb. 3, 2004

(54) COLOR DISPLAY TUBE COMPRISING AN INTERNAL MAGNETIC SHIELD

(75) Inventors: Adrianus Johannes Van Mensvoort, Eindhoven (NL); Ben Heinz Hageluken, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 167 days.

(21) Appl. No.: 09/891,492

(22) Filed: Jun. 26, 2001

(65) Prior Publication Data

US 2002/0014824 A1 Feb. 7, 2002

(30) Foreign Application Priority Data

Jun. 30, 2000 (EP) ..... 00202299

(51) Int. Cl.[7] ..... H01J 29/74; H01J 29/46

(52) U.S. Cl. ..... 313/433; 313/479; 313/402; 313/442

(58) Field of Search ..... 313/433, 479, 313/407, 477 R, 481, 440, 442

(56) References Cited

U.S. PATENT DOCUMENTS 4,230,966 A * 10/1980 Compen ..... 313/481
4,571,521 A * 2/1986 Gallaro et al. ..... 313/402
5,336,962 A * 8/1994 Keller ..... 313/402
5,434,470 A * 7/1995 De Wit et al. ..... 313/402
2001/0026119 A1 * 10/2001 Murai et al. ..... 313/433

FOREIGN PATENT DOCUMENTS

EP 0503709 A2 3/1992 ..... H01J/29/06

* cited by examiner

*Primary Examiner*—Ashok Patel
*Assistant Examiner*—German Colón
(74) *Attorney, Agent, or Firm*—Eric Bram

(57) ABSTRACT

A color display tube with an elongated phosphor screen having a pattern of discrete phosphor elements. In order to reduce landing errors of the electron beams, in particular in the X direction, and simultaneously minimize the amount of magnetic material used for the internal magnetic shield, the color display tube has an internal magnetic shield consisting of a tub that is deep-drawn from a foil, which tube has a bottom with an aperture for allowing passage of electrons. Material of the bottom adjoining the aperture for allowing passage of electrons has been bent outwards from the plane of the bottom. In this manner, material of the bottom of the tub which would otherwise have been cut away is used to enlarge the "virtual" height of the magnetic shield.

7 Claims, 6 Drawing Sheets

COLOR DISPLAY TUBE COMPRISING AN INTERNAL MAGNETIC SHIELD

FIELD OF TECHNOLOGY, BACKGROUND, AND SUMMARY

The invention relates to a color display tube with an envelope comprising

- a neck portion, a funnel-shaped portion and a window portion;
- an electron gun system arranged in the neck portion;
  - an elongated display screen having a phosphor pattern on the inner surface of the window portion;
  - a color selection means arranged opposite the display screen;
- an internal magnetic shield arranged inside the funnel-shaped portion, which magnetic shield comprises two long side walls extending parallel to the long axis of the display screen (the x axis), two short side walls extending parallel to the short axis of the display screen (the y axis), and, on the side of the electron gun, an aperture allowing electrons to pass, which aperture extends transversely to the longitudinal axis of the display tube.

The term "color selection means" is to be taken to mean herein, for example, a shadow mask plate provided with apertures, or a wire mask.

In a (color) display tube, the earth's magnetic field causes deflection of the electron paths, which, without countermeasures, may be so substantial that the electrons impinge on a wrong phosphor (mislanding), leading to discoloration of the image. Particularly the component of the earth's field in the axial direction of the display tube (the so-called axial field) is important in that it may manifest itself as a lack of color or even as color impurities in the corners of the display screen.

A well-known measure of reducing mislandings caused by the earth's magnetic field is the use of an internal magnetic shield. The shape of such a shield broadly follows the contours of the envelope of the display tube. This means that the (funnel-shaped) shield comprises two long, more or less trapezoidal sides extending parallel to the long axis (the x axis) of the display screen, and two short, more or less trapezoidal sides extending parallel to the short axis (the y axis) of the display screen.

In many types of color display tubes, this shield consists of an iron (bath) tub deep-drawn from strip material, which tub is provided with one or more functional openings. A drawback of the deep-drawn product resides in that a fairly substantial part of the strip material has to be disposed of as scrap. Other types of color display tubes often comprise a magnetic shield which is cut from a flat sheet and subsequently bent. In the case of the bent shield, the percentage of scrap is often smaller than in the deep-drawn shield, however, the necessary additional operations, such as spot welding or manual bending of fastening lugs, lead to higher costs. Bent shields are employed in display tubes in various embodiments, however, there is a trend towards deep-drawn shields because they can be manufactured more economically in large numbers. In view of the difficult competitive position of display tubes, in particular with respect to LCDs, a still further reduction in costs is required. Therefore, it is an object of the invention to provide an embodiment of a (deep-drawn) shield which can be manufactured more economically while its magnetic performance is maintained.

To achieve this, a display tube of the type mentioned in the opening paragraph is characterized in accordance with the invention in that the shield is a tub drawn from a sheet or strip material (slug), the bottom of the tub being provided with a central opening for allowing electrons to pass, and material of the bottom adjoining the central opening being bent outwards from the plane of the bottom.

The invention enables the costs of the shield to be minimized while the desired magnetic shielding performance is maintained. The cost reduction can be achieved by reducing the depth of draw of the bath tub, as a result of which a smaller slug from the strip material is needed. The part of the bottom that remains after cutting out the opening allowing electrons to pass is often referred to as the shield diaphragm. In the invention, the shield diaphragm cut from the bottom of the tub is smaller than the opening for allowing passage of electrons in the bottom of the tub, whereafter the excess part is bent outwards such that corner cutting of the electron beam cannot take place.

A practical embodiment of a display tube in accordance with the invention is characterized in that the opening allowing passage of electrons in the shield is elongated and includes a pair of opposite long sides, and in that strips of the material of the bottom adjoining the long sides of the opening are bent outwards from the plane of the bottom.

In certain types of display tubes it is advantageous if strips of the material of the bottom are bent outwards along both the long and the short sides of the opening.

The above-mentioned measures enable the effect of an optimum shield height to be achieved, using, for example, a 20% smaller slug and a smaller shield height, as a result of which optimum magnetic shielding is achieved using 20% less material.

The use of a slug which is more than 20% smaller than the customary slug, particularly a slug which is more than 25% smaller, generally no longer leads to the desired result. In practice, 10 to 15% smaller slugs proved very suitable, both from the viewpoint of material economy and magnetic shielding. In addition, the use of said slugs enables the total design to be realized in a simple manner, whereby corner cutting of the electrons is precluded.

The display screen is generally elongated and so is the opening allowing passage of electrons in the bottom of the shield, i.e. said opening has two long sides and two short sides. In the case of display tubes having a line mask structure, i.e. the phosphor pattern is a line pattern, preferably strips of the bottom material are bent which adjoin the long sides of the opening allowing passage of electrons. In said display tubes the measure in accordance with the invention is most effective. At smaller formats, such as 14" tubes and 20 V tubes, the invention is particularly attractive. In the case of display tubes having a hexagonal mask structure, where the phosphor pattern is a pattern of dots, preferably, strips of the bottom material are bent which adjoin the short sides of the opening allowing passage of electrons.

The angles through which the material strips are bent from the plane of the bottom also is an important parameter. This angle, indicated in the Figures by means of β, should preferably be smaller than the maximum deflection angle, indicated in the Figures by means of a, including overscan. Preferably 5 to 30 degrees smaller. Within this range, the size depends, inter alia, on the depth of the tube (the depth of a 90° tube exceeds that of a 110° tube).

Further preferred embodiments are:

- the smallest distance between the material strips bent from the plane of the bottom, indicated in the Figures by means of $W_{top}$, is at least 5% smaller than the maximum width of the diaphragm opening, indicated in the Figures by means of $W_{max}$.

the total height of the shield, indicated in the Figures by means of $H_{tot}$, is at least 10% larger than the height of the body of the tub, indicated in the Figures by means of $H_{bod}$. These and other aspects of the invention will be apparent from and elucidated with reference to the embodiment(s) described hereinafter.

DESCRIPTION OF THE DRAWING FIGURES

In the drawings:

FIG. 1*a* is a cross-sectional view of a color display tube;

FIG. 1*b* diagrammatically shows the origin of mislanding;

Figure 4:
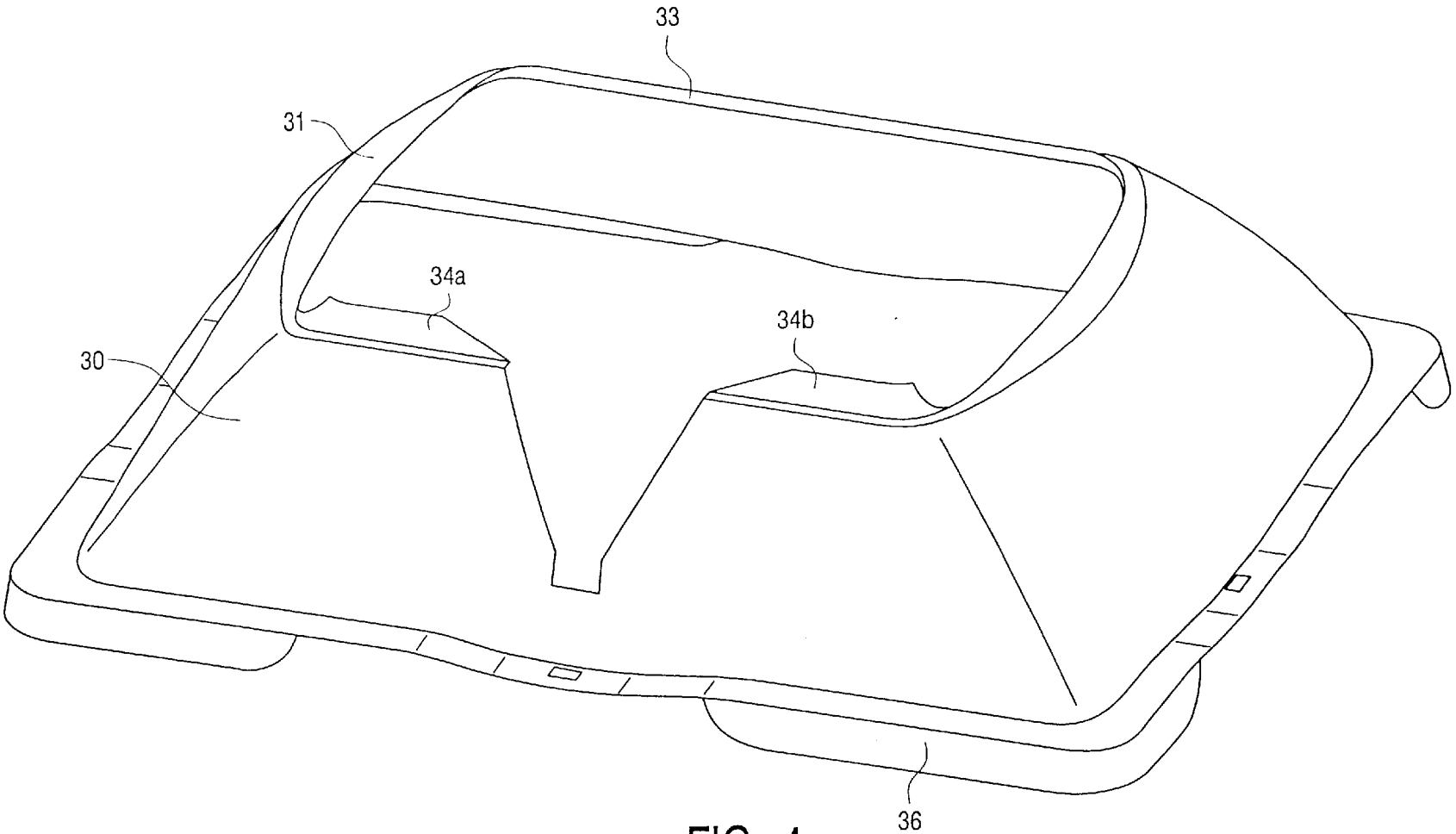
FIG. 4 is a perspective view of a first embodiment of a shield for a display tube in accordance with the invention.
Figure 5A:
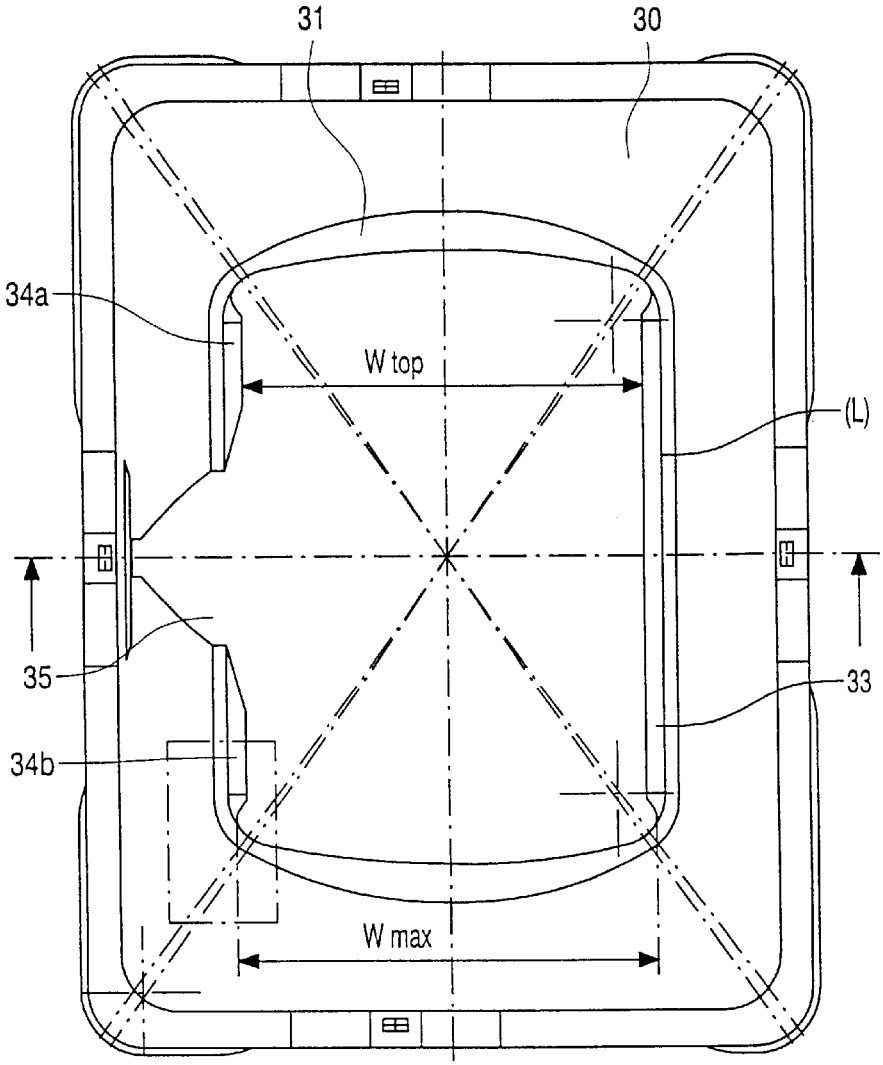
Figure 5B:
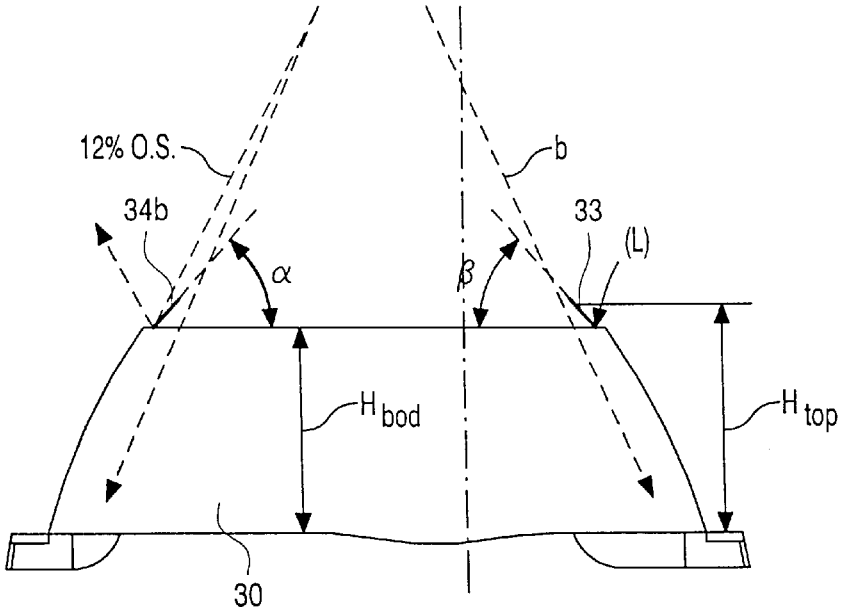
Figure 6A:
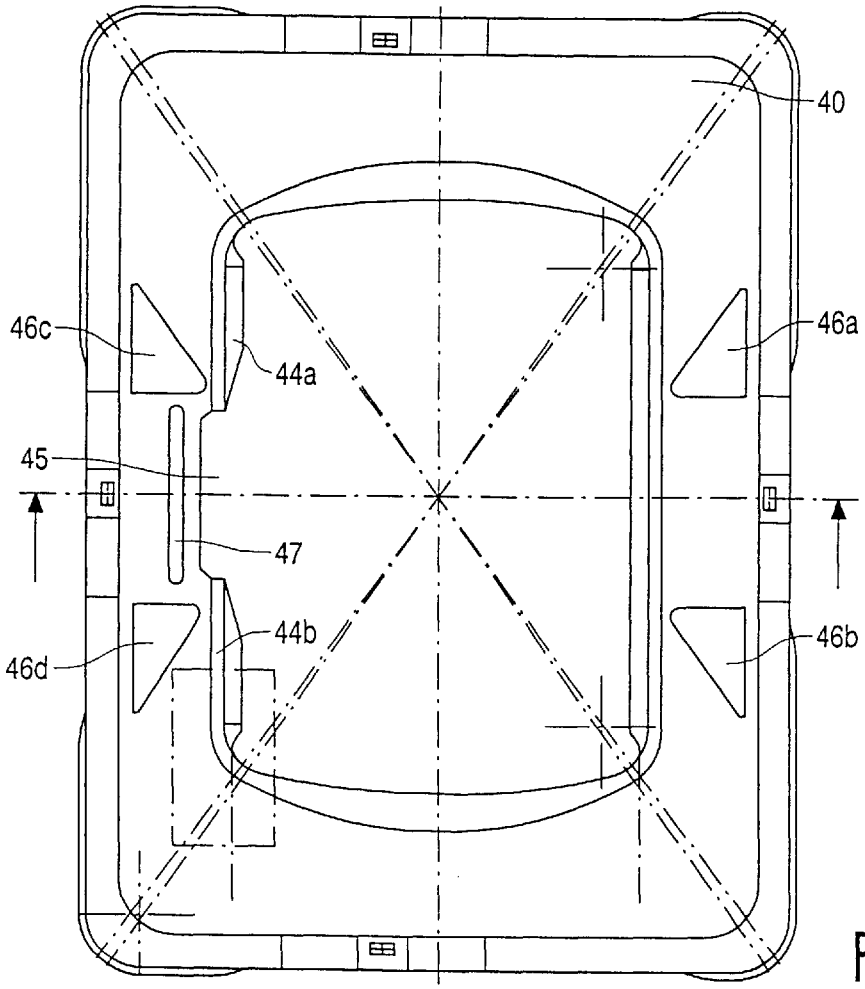
Figure 6B:
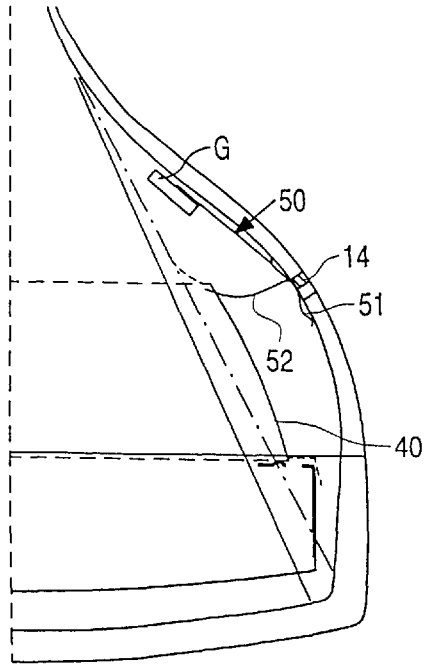

FIG. 5*a* is a plan view of the shield shown in FIG. 4;

FIG. 5*b* is a side view, seen from the short side, of the shield in accordance with FIG. 4;

FIG. 6*a* is a plan view of a second embodiment of a shield for a display tube in accordance with the invention;

FIG. 6*b* is a cross-sectional view of a part of a display tube comprising a shield in accordance with FIG. 6*a;*

Figure 7:
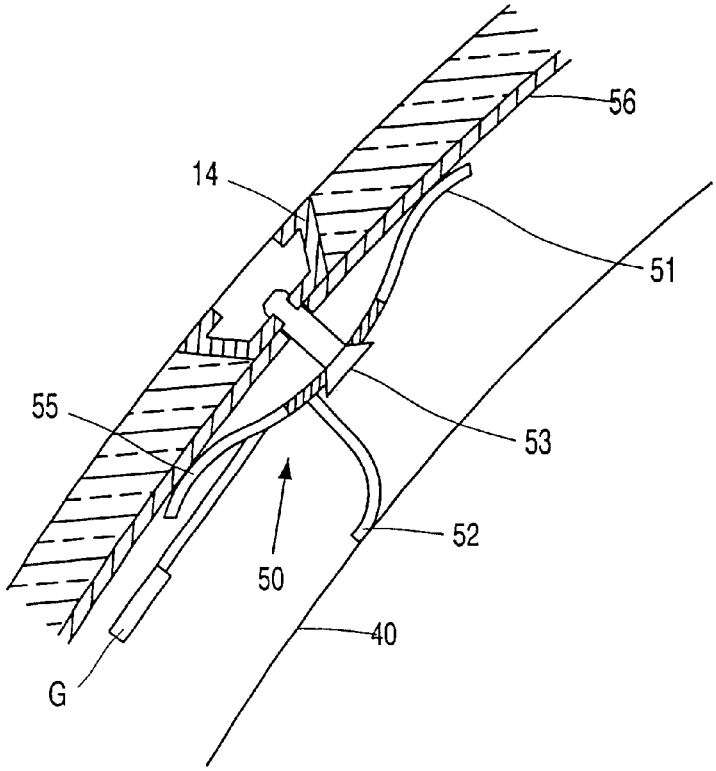
Figure 8:
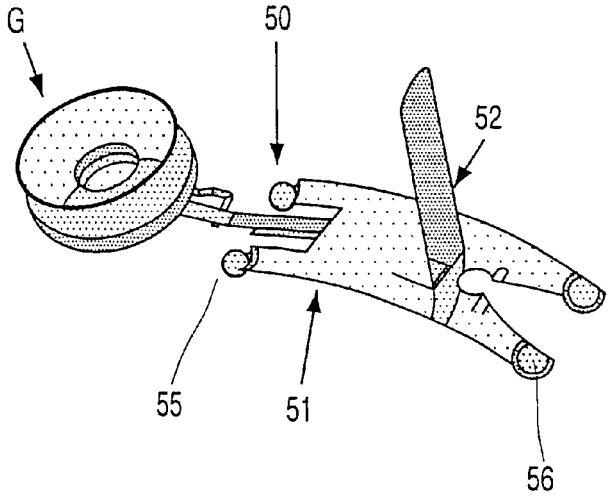

FIG. 7 is a cross-sectional view of a wall of a display tube comprising a high-voltage contact and a getter assembly; and FIG. 8 is a perspective view of the getter assembly shown in FIG. 7.

DETAILED DESCRIPTION

Figure 1A:
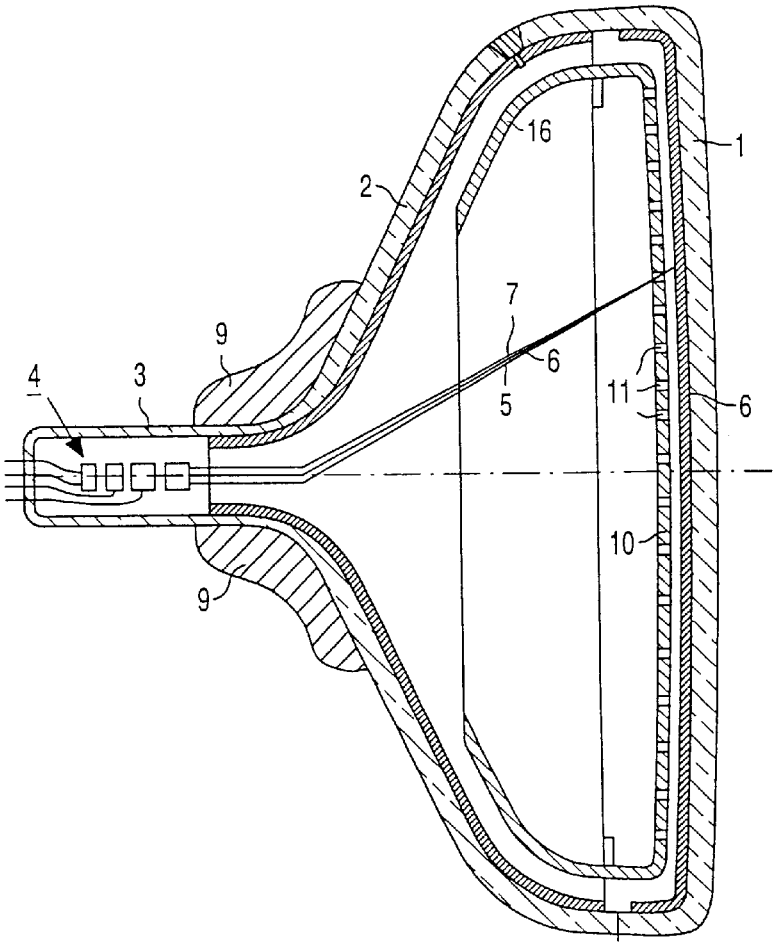

FIG. 1*a* is a horizontal, cross-sectional view of a display tube comprising a glass envelope consisting of a display window 1, a funnel-shaped portion or cone 2 and a neck 3. The neck 3 accommodates an electrode system 4 comprising three electron guns for generating three electron beams 5, 6 and 7. The electron beams are generated in one plane (in this case, the plane of the drawing) and are directed towards a display screen 8 provided on the inside of the display window 1, which display screen is composed of a large number of discrete phosphor elements luminescing in red, green and blue and coated with an aluminium layer. On their way to the display screen 8, electron beams 5, 6 and 7 are deflected across the display screen 8 by means of a deflection coil system 9 which is coaxially arranged about the tube axis, and the electron beams pass through a color selection electrode 10 composed of, for example, a metal sheet having openings 11. The three electron beams 5, 6 and 7 pass through the openings 11 at a small angle with each other and, consequently, each electron beam impinges only on phosphor elements of one color. The tube further comprises a high-voltage contact (anode contact) 14 arranged in the wall of the tube. The color selection electrode 10 is suspended opposite the display screen 8. A funnel-shaped magnetic shield 16 is arranged inside the glass envelope.

Figure 1B:
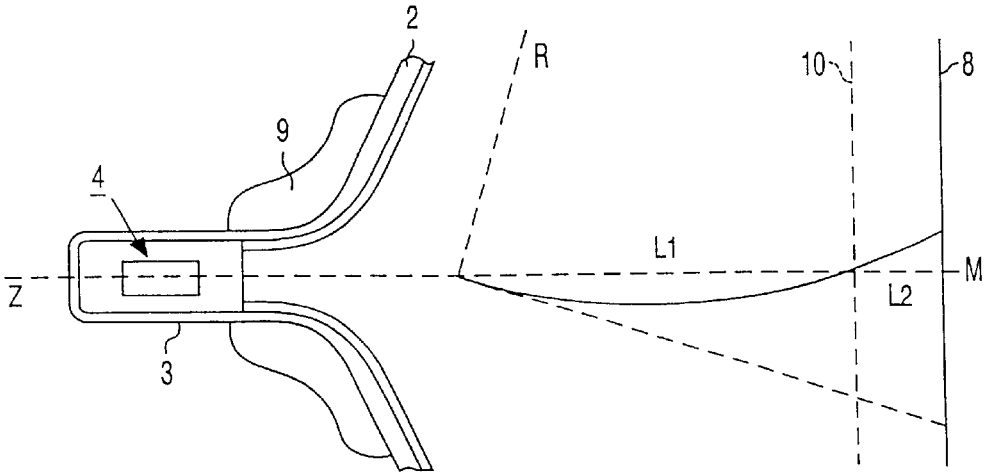

In a color display tube, electrons pass through holes of a shadow mask and are incident on a phosphor. The position of the phosphors is optimal for one orientation of the tube in one specific terrestrial field (location on earth). For another orientation or terrestrial field, the electron is incident on a different spot on the shadow mask. This leads to a distortion of the image, which is particularly disadvantageous for color monitors. In addition, the electron reaches the mask at a different angle. If the electron passes through a hole, the influence of a field at right angles to its direction of movement, causes mislanding M of the electron on the screen. See FIG. 1*b*. If the degree of mislanding is too large, it is even possible that a wrong phosphor is reached, resulting in color errors.

Hereafter, a calculation is given of the degree of mislanding when the terrestrial field is not compensated for at all. In a homogeneous field of size B, the electron describes a path of radius R which is given by $R=mv_0/eB$, where m, $v_0$ and e are, respectively, mass, velocity and charge of the electron. At a terrestrial field of $5*10^{-5}$T (~V½ gauss), a velocity of the electrons $v_0$ of $10^8$ m/sec and $e/m=1.076\times10^{11}$ C/kg, the value of R=11.4 m. A simple geometric consideration results in the following value for the mislanding M:

$$M \approx \frac{L_1 \cdot L_2 \cdot eB}{2mv_0}$$

where L1 is the distance from the source of electrons to the shadow mask, and L2 is the distance from the shadow mask to the screen. It is important to reduce mislanding as much as possible because it leads, for example, to a reduction in brightness of the tube. An increase of the tube leads to an increase of L1 and L2, so that mislanding increases quadratically.

The direction of the disturbing magnetic field in the tube depends on the place and the orientation of the set. To adapt the magnetization of the shield to the field present in a specific situation, the shield is demagnetized by means of a decreasing alternating field each time the set is switched on.

On the side of the electron gun, the shields inevitably comprise an opening for allowing passage of electrons. On the side of the display screen, the shields are completed by the shadow mask, which is made of a magnetic material.

The invention is based on the combination of a minimal material usage and a comparatively optimal design of the shield on the electron gun side.

Figure 2:
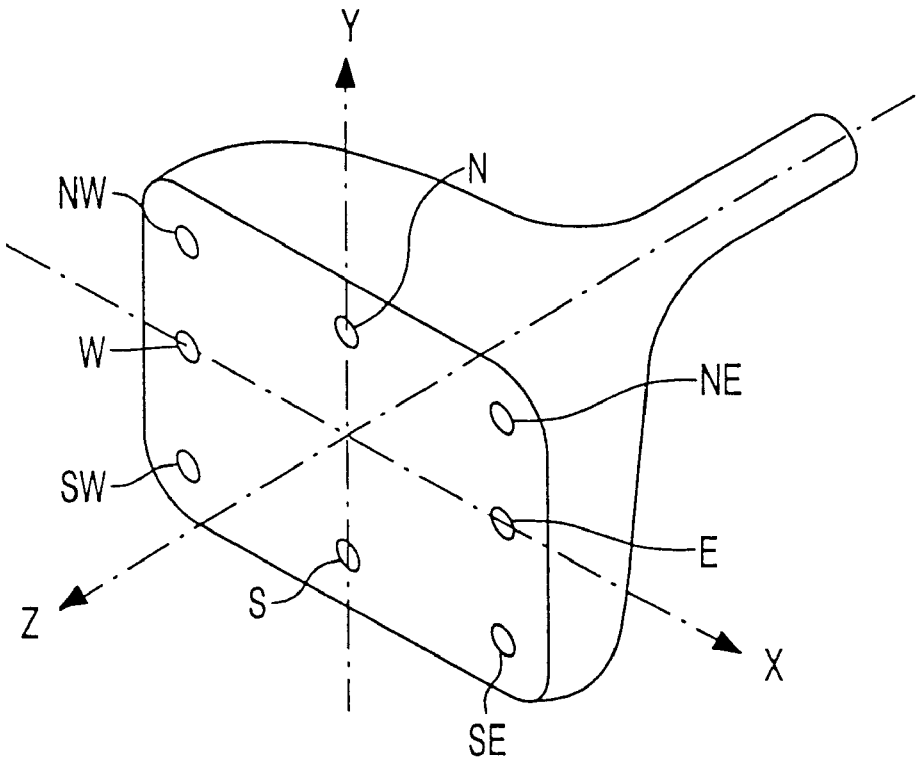
FIG. 2 is a diagrammatic, perspective view of a color display tube, wherein a system of co-ordinates is indicated as well as the positions on the display screen where beam mislandings are measured.

In order to simplify the following explanation, FIG. 2 gives a definition of a system of co-ordinates in a display tube and of locations on the screen. Here, only the component of the terrestrial field in the z direction is considered, i.e. the so-called axial field.

Figure 3:
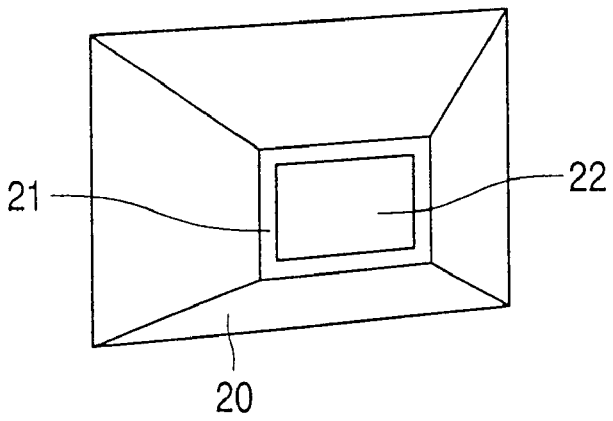
FIG. 3 is a perspective view of an embodiment of an internal shield in accordance with the prior art.

FIG. 3 shows a conventional shield 20 having a bottom 21 with an opening 22 for allowing passage of electrons. The height of the shield (the distance between the bottom and the front side) is comparatively large, so that the shield must be drawn from a comparatively large slug.

Shield 30 (FIG. 4) in accordance with the invention is obtained by deep-drawing a sheet of a soft magnetic material, such as steel having a low carbon content, the thickness of said sheet ranging from one tenth to several tenths of one mm.

In this simple embodiment, strips 33, 34*a*, 34*b* bent from the bottom 31 (in the direction of the gun) are provided only along the long sides of the shield diaphragm. FIG. 5*a* shows a plan view, and FIG. 5*b* shows a side view, seen from a short side. The starting slug can be substantially smaller because, in this case, material of the bottom of the tub which otherwise would have been cut away, is used to increase the "virtual" height of the shield.

This is explained by means of a few examples regarding the dimensions of slugs for shields in 90° tubes:

Conventional slug for 14" tube: 32,5×38.0=1235 $cm^2$.

Practical embodiment of a slug for a 14" tube in accordance with the invention: 27.0×34.0 =918 $cm^2$.

Saving: 26%.

Conventional slug for a 20 V tube: 48.5×54.0=2619 $cm^2$.

Practical embodiment of a slug for a 20 V tube in accordance with the invention: 43.0×50.0=2150 $cm^2$.

Saving: 18%.

Conventional slug for a 25 V tube: 52.0×62.0=3224 $cm^2$.

Practical embodiment of a slug for a 25 V tube in accordance with the invention: 46.5×58.0=2697 $cm^2$.

Saving: 16%.

It is to be noted that the measures in accordance with the invention are most effective in smaller tube types and at deflection angles of 90°. The relative saving in material decreases as the size (the diagonal of the display screen) of the tube increases. By applying the measures in accordance with the invention, it is also possible to, completely or partly, omit the so-called skirt 36 (FIG. 4) of the shield, which also contributes to the material economy. However, omitting the skirt is only possible when the shadow mask-shield combination is suspended between the angular points, not in the case of the so-called corner suspension. Apart from the above examples, the invention can also advantageously be applied to Real Flat tubes (in particular 15" to 21" RF tubes). The shield 30 comprises a so-called soft-flash opening 35, enabling it to be used in combination with a "soft-flash" getter on the anode contact.

The following Design Rules are Typical of the Invention

The width $W_{top}$ is at least 5% smaller than the maximum shield diaphragm width $W_{max}$.

The maximum height $H_{top}$ is at least 10% higher than $H_{bod}$.

A bending line (L) extends along each long side. This bending line is additional to the bending line already present at the location where the bottom joints the side wall. This construction has a favorable effect on the strength. If necessary, however, one bending line is sufficient; in which case the side wall joints the upright strip directly as it were.

The bending angle β of the upright strip on the long side is 5 to 30 degrees smaller than the angle α, which is equal to the complement of half the deflection angle.

FIG. 6*a* shows an example of a shield 40, wherein the so-called soft-flash opening 45 is minimized. This embodiment is mechanically more robust and magnetically more symmetrical, as a result of which a further optimization of magnetic shielding, such as the use of windows 46*a*, 46*b*, 46*c*, 46*d*, enabling an improvement in the case of a lateral field becomes possible. This example can be realized using a special getter assembly 50, in particular as regards the suspension, as shown in FIG. 6*b*. This system enables even an anode getter to be used without a mechanically and magnetically disadvantageous soft-flash opening in the shield being necessary. A hole remains necessary only in the center of the bent strip 44*a*, 44*b*. In this case, also the strengthening ridge 47 can be omitted. FIG. 7 is a more detailed view of the getter assembly 50 slid onto a contact pin 53 of anode contact 14, which getter assembly includes a metal supporting spring 51 provided with springing end portions 54, 55 which contact a resistance layer 56. A springing contact strip 52 is provided transversely to the supporting spring 51 to ensure that the getter assembly firmly contacts the shield 40 at a location near the bottom thereof. The getter container G is situated, in this construction, at such a location that a "soft-flash" opening in the shield (of reduced height) can be omitted either completely or substantially completely.

In addition, the supporting spring 51 can be advantageously embodied so as to be slidable from the gun side onto the contact pin 53 of the anode contact 14. Of course, example two can also be applied to tubes with an antenna getter, i.e. a getter situated on the front of the electron gun.

In summary, the invention relates to a color display tube comprising an elongated display screen with a pattern of discrete phosphor elements and an internal magnetic shield arranged between the phosphor elements and an electron gun. In order to minimize errors caused by mislanding of the electron beams, particularly in the x direction, in combination with a minimal use of magnetic material for the shield, the color display tube comprises an internal shield made of a tub which is deep-drawn from a foil, which tub has a bottom with an opening for allowing passage of electrons. Material of said bottom adjoining the opening for allowing passage of electrons is bent outwards from the plane of the bottom. In this way, material of the bottom of the tub, which otherwise would have been cut away, is used to increase the "virtual" height of the shield.

What is claimed is:

1. A color display tube comprising:

an envelope;

an electron gun system arranged in a neck portion of the envelope;

an elongated display screen having a phosphor pattern on the inner surface of a window portion of the envelope;

a color selection means arranged opposite the display screen;

an internal magnetic shield arranged inside a funnel-shaped portion of the envelope, the internal magnetic shield including two long side walls extending parallel to the long axis of the display screen (the x axis), two short side walls extending parallel to the short axis of the display screen (the y axis), and, on a side of the electron gun, an open end portion extending transversely to the long longitudinal axis of the display tube, wherein the magnetic shield is a tub drawn from a sheet or strip material, the bottom of the tub is provided with a central opening for allowing electrons to pass, material of the bottom adjoining the central opening is bent outwards from the plane of the bottom, and the material of the bottom is bent outwards in the form of strips through an angle β which is smaller than the maximum deflection angle of the electron beams including overscan.

2. The display tube of claim 1, wherein β is between 5 and 30° smaller than the maximum deflection angle including overscan.

3. A display tube as claimed in claim 1, characterized in that the opening for allowing passage of electrons is elongated and includes a pair of opposite long sides and a pair of opposite short sides, and in that strips of the material of the bottom are bent outwards along the long and short sides.

4. A display tube as claimed in claim 1, characterized in that the material of the bottom is bent outwards in the form of strips through an angle β which is smaller than the maximum deflection angle of the electron beams including overscan.

5. A display tube as claimed in claim 4, characterized in that β is between 5 and 30° smaller than the maximum deflection angle including overscan.

6. A display tube as claimed in claim 1, characterized in that the funnel-shaped portion of the envelope comprises a high-voltage contact on which a getter assembly is arranged, which getter assembly is provided with a transverse contact strip which contacts the shield near the bottom of the shield.

7. A display tube as claimed in claim 1, characterized in that said display tube is of the type where the color selection means is suspended at locations between the angular points.

* * * * *